United States Patent [19]

Esper et al.

[11] Patent Number: 5,018,660

[45] Date of Patent: May 28, 1991

[54] CONTAINER AND BLANK FOR CONSTRUCTING SAME

[75] Inventors: Leo J. Esper, Troy; David C. Jorgensen, Walled Lake; Howard E. Murrah, Fenton; Michael G. Schneider, Wixom; Raymond M. Phillips, Redford, all of Mich.; Bruce C. Dauzy, Lima, Ohio

[73] Assignee: Elopak Systems, A.G., Glattbrugg, Switzerland

[21] Appl. No.: 527,115

[22] Filed: May 22, 1990

[51] Int. Cl.[5] ..... B65D 5/74

[52] U.S. Cl. ..... 229/125.42; 229/136

[58] Field of Search ..... 229/125.42, 136

[56] References Cited

U.S. PATENT DOCUMENTS 2,079,876 5/1937 Reiter ..... 229/125.42

4,746,061 5/1988 Arvanigian ..... 229/136

4,811,849 3/1989 Rausing ..... 229/125.42

4,860,902 8/1989 Kieser ..... 229/125.42

*Primary Examiner*—Joseph Man-Fu Moy

*Attorney, Agent, or Firm*—John P. Moran

[57] ABSTRACT

A liquid carrying, thermoplastic coated paperboard container including a top end closure, a four-sided body portion, and a bottom end closure, wherein various end closure panels are folded so as to abut against one another to become sealed thereagainst. To effectuate the sealing, a pressure sensitive, food grade adhesive is applied to at least one of each two abutting surfaces and the abutting surfaces are pressed together without the application of heat or high frequency vibration. The adhesive may be applied to the blank during the converting process, or while the blank is being formed into a container on the forming, filling and sealing machine.

5 Claims, 5 Drawing Sheets

CONTAINER AND BLANK FOR CONSTRUCTING SAME

TECHNICAL FIELD

This invention relates generally to thermoplastic coated liquid carrying paperboard containers and, more particularly, to a blank and a container formed from the blank with improved sealing features.

BACKGROUND ART

Containers for beverages such as milk, cream, other dairy products, juices, and the like are conventionally constructed from thermoplastic coated paperboard. One type of these containers includes a top end closure with a folded gable roof having a vertically projecting seal at the roof ridge for sealing the container and providing a readily available pouring spout when the contents of the container are to be dispensed.

Thermoplastic coated paperboard blanks for constructing such a container are made on converting machines similar to those disclosed by Monroe et al. U.S. Pat. No. 2,682,208 and Earp U.S. Pat. No. 3,731,600. After construction, the blanks are processed by forming, filling and sealing machines, such as those disclosed by Monroe et al. U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the type referred to above and shown and described in Egleston et al. U.S. Pat. Nos. 3,270,940 and 3,120,335.

Typically, as shown and described in the forming, filling and sealing machines of the above referenced U.S. Pat. Nos. 3,303,761; 3,918,236 and 3,398,659, there are heating stations included on the machines to heat the various thermoplastic coated surfaces so that they can then be sealed together under pressure. Alternatively, as disclosed in the U.S. Pat. No. 4,193,833, sealing may be accomplished by ultrasonic or high frequency vibration.

For particular applications, a so-called thermoplastic "hot melt" may be applied as a sealant for various panel surfaces, or to serve as a sealant for crevices that may occur between the adjacent edges of co-planar panels after closing.

In still other prior art liquid carrying container arrangements, such as that shown and described in Wyberg U.S. Pat. Nos. 4,813,548 and 4,756,426, a fillet comprising a thin strip of stiff material coated with or adjacent to a layer of adhesive, which may be a type of pressure sensitive adhesive approved for food contact, is attached to the gable rib panels which form the spout. These arrangements contemplate the application of the usual heat sealing process to establish a conventional thermoplastic-to-thermoplastic bond.

DISCLOSURE OF THE INVENTION

An object of the invention is to provide an improved sealing arrangement for liquid carrying thermoplastic coated paperboard containers.

Another object of the invention is to provide a container sealing arrangement which does not require either heat or a high frequency vibration, or the application of a hot melt material.

A further object of the invention is to provide a pressure sensitive, food grade (FDA approved) adhesive for sealing liquid carrying thermoplastic coated paperboard containers, in lieu of having to apply heat or use ultrasonic or high frequency vibration to effectuate the sealing process, as has heretofore generally been the case.

These and other objects and advantages of the invention will become more apparent when reference is made to the following description and accompanying drawings.

BEST MODE OF CARRYING OUT THE INVENTION

Figure 1:
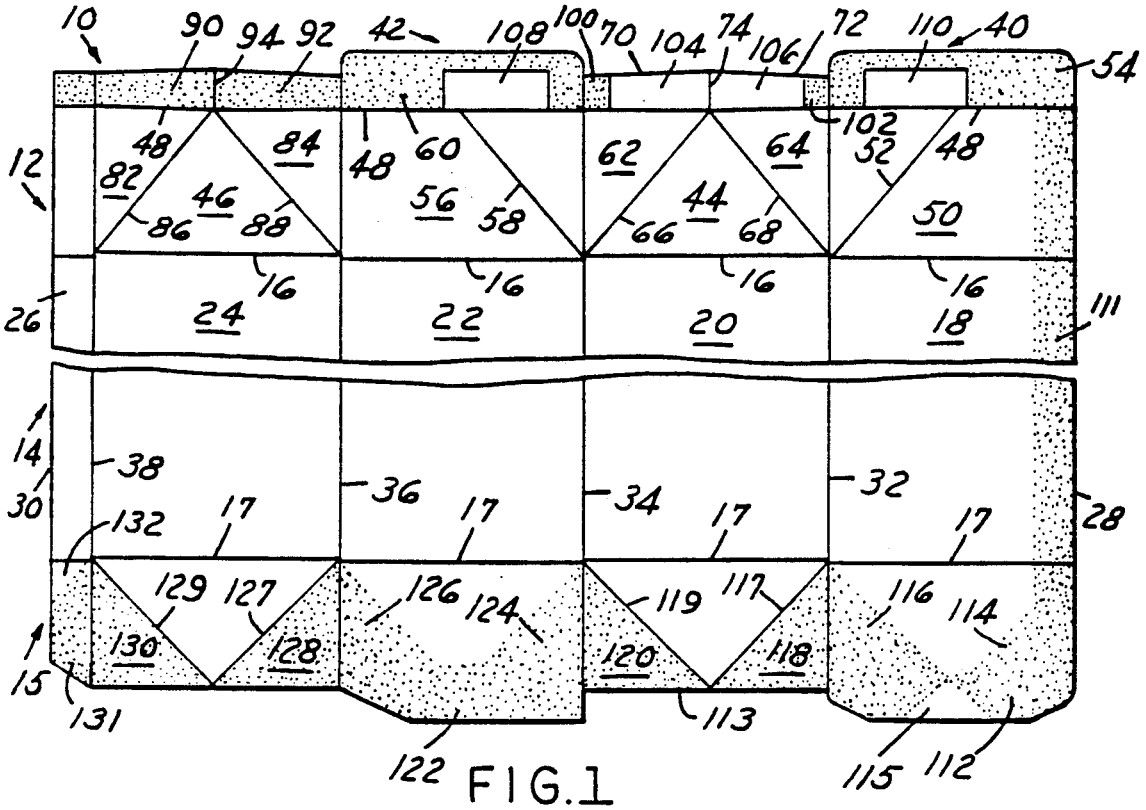
FIG. 1 is a fragmentary layout view of the inside surface of a coated paperboard container blank used to construct a container having end closures adaptable to being sealed in accordance with the present invention.

Referring now to the drawings in greater detail, FIG. 1 illustrates a thermoplastic coated container blank 10 interior surface formed in accordance with the principles of the present invention. The container blank 10 is generally divided into three sections including a top end closure 12, a body portion 14, and a bottom end closure 15. The latter may be similar to that shown and described in Egleston et al., U.S. Pat. No. 3,120,335, and incorporated herein by reference. A staggered lower top horizontal score line 16 extends transversely across the container blank 10 and separates the top end closure 12 and the body portion 14. Similarly, a bottom staggered horizontal score line 17 extends transversely across the container blank 10 and separates the bottom end closure 15 and the body portion 14.

The body portion 14 comprises a plurality of integrally connected body panels, namely, a side panel 18, a front panel 20, a side panel 22 and a back panel 24, and a side seam flap or narrow fifth panel 26 formed adjacent the panel 24. The container blank 10 is defined on its longitudinal sides by its edges 28 and 30. The body panels 18, 20, 22 and 24, and the side seam flap 26 are defined by vertical score lines 32, 34, 36 and 38.

The top end closure 12 comprises roof panels 40 and 42. The panels 40 and 42 are connected integrally to the upper ends of the body panel members 18 and 22, respectively. A triangular gable or spout panel 44 and a triangular gable or closure panel 46 are connected integrally to the body panels 20 and 24, respectively. A staggered upper top horizontal score line 48 extends transversely from the blank edge 28 to the blank edge 30, substantially parallel to the horizontal score line 16.

The roof panel 40 is divided basically into two portions by the horizontal score line 48. A lower closure panel 50 is defined by the score line 32 and the edge 28. An opening assist score line 52 extends substantially from the intersection of the score line 16 and the score line 32 to a point on the score line 48 that is closer to the score line 32 than to the edge 28. An upper closure panel 54 of the outer roof panel 40 serves as a sealing panel, as will be explained.

The roof panel 42 is divided into two parts by the score line 48. The inner part of the roof panel 42 comprises a lower closure panel 56 which is defined by the horizontal score lines 16 and 48 and the vertical score lines 34 and 36. An opening assist score line 58 extends from the intersection of score lines 16 and 34 to a point on the score line 48. The last mentioned intersection on the score line 48 is closer to the score line 34 than to the score line 36, and it is substantially the same distance from the score line 34 as the opening assist score line 52 is from the score line 32 along the score line 48. The roof panel 42 includes an upper closure panel 60 which is integral with the closure panel 56, and it is separated therefrom by the score line 48.

The triangular spout panel 44 is connected to a pair of inner roof or fold-back panels 62 and 64 by diagonal score lines 66 and 68, respectively. The fold-back panels 62 and 64 connect the triangular spout panel 44 to the closure panels 56 and 50, respectively. A pair of pouring panels or infold lips 70 and 72 are integrally connected to the fold-back panels 62 and 64, respectively, and they are defined by a portion of the horizontal score line 48, the vertical score lines 32 and 34, and a vertical score line 74.

The triangular closure panel 46 is integrally connected to a pair of inner roof or fold-back panels 82 and 84 by diagonal score lines 86 and 88, respectively. The fold-back panel 82 integrally connects the triangular closure panel 46 to the extension of the fifth panel 26. A pair of closure panels or infold lips 90 and 92 are connected to the fold-back panels 82 and 84, respectively, and they are defined at their lower ends by the score line 48 and at their outer edges by the score lines 38 and 36, respectively. The closure panels 90 and 92 are separated from each other by a vertical gable score line 94. The triangular base angles of the closure panel 46 as well as of the spout panel 44, are normally formed so as to be equal.

Figure 2:
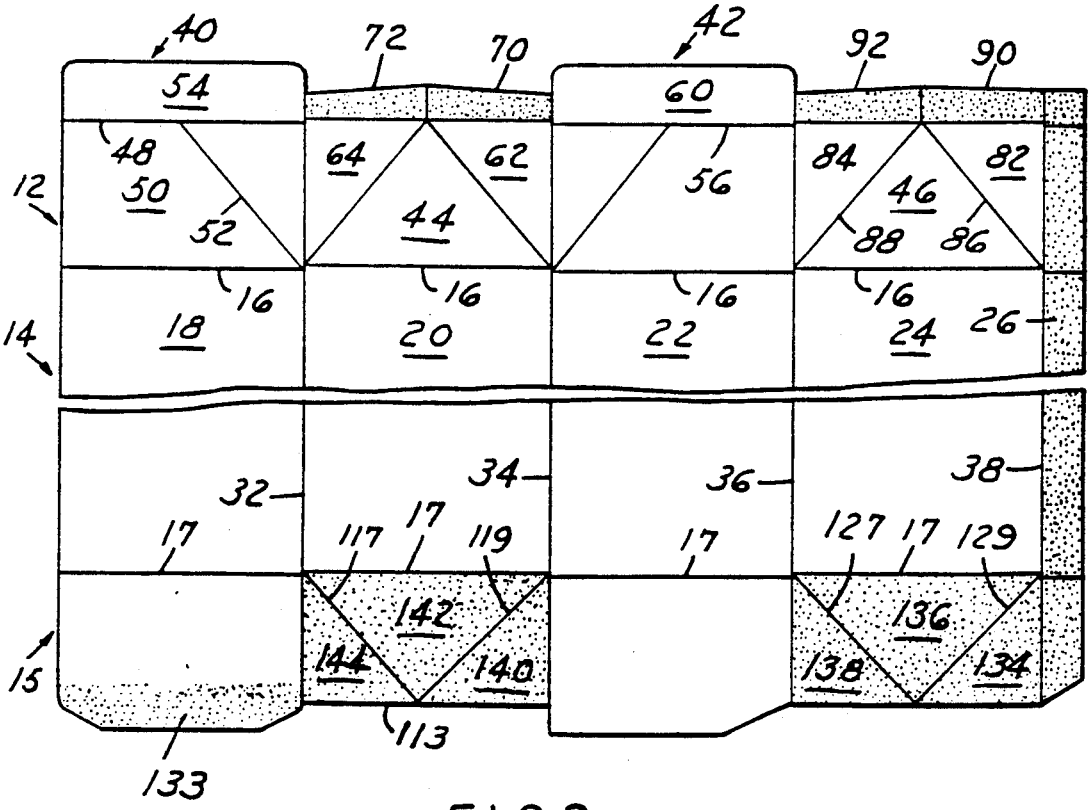
FIG. 2 is a fragmentary layout view of the outside surface of the container blank in FIG. 1.
Figure 3:
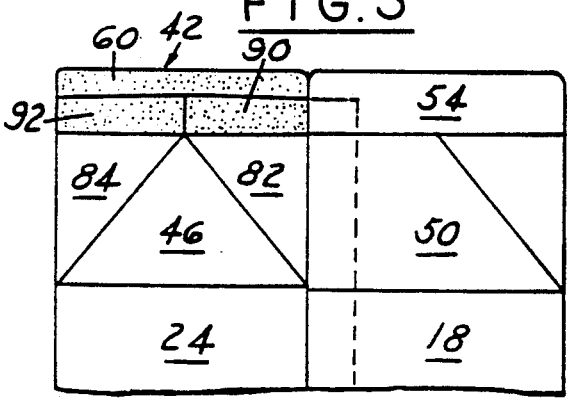
FIG. 3 is a fragmentary layout view of the outside surface of a container structure after it is side seamed from the container blank illustrated in FIGS. 1 and 2.
Figure 4:
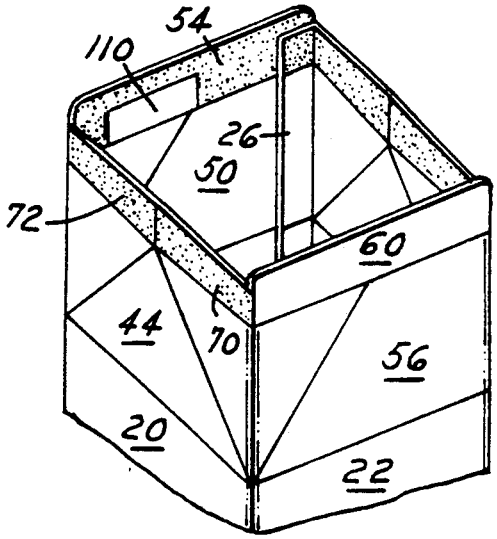
FIG. 4 is a fragmentary perspective view showing the side seamed container blank illustrated in FIG. 3 in an open ended top end view prior to the closing of the top closure structure of the present invention.

Referring now to FIG. 2, there is shown the exterior surface of the container blank 10 of FIG. 1. The respective exterior panels are identified the same as for their interior counterparts shown in FIG. 1.

A pressure sensitive food grade (FDA approved) adhesive is preferably applied to the blank 10 while the blank is being scored and printed on the usual converting machine, such as that disclosed in the above referenced U.S. Pat. Nos. 2,682,208 and/or 3,731,600, prior to being cut into individual blanks. However, such adhesive may be applied to the various surfaces of the blank while it is being formed into a container on a forming, filling and sealing machine, such as those disclosed in the above referenced patents modified to include one or more adhesive-applying stations. More specifically, the food grade adhesive is applied to the following areas, shown as stippled areas in FIGS. 1 and 2:

(a) The full exterior (FIG. 2) infold lips 70, 72, 90 and 92;

(b) The full interior (FIG. 1) infold lips 90 and 92, and outer left and right edge portions 100 and 102 of the respective interior infold lips 70 and 72, adjacent the respective closure panels 60 and 54, leaving clear areas 104 and 106; and (c) The full interior (FIG. 1) closure panels 60 and 54, except for respective rectangular portions 108 and 110 at the lower, central section of each of the respective right and left halves of the panels 60 and 54, adjacent the score line 48. As such, the food grade adhesive is applied adjacent the left, right and upper edges of each of the rectangular portions 108 and 110, as shown in FIG. 1.

The clear areas 104, 106, 108 and 110 are reserved for the application, if it is required, of a suitable adhesive material of a type and for a purpose well known in the art, as will be explained later.

The container blank 10 illustrated in FIGS. 1 and 2 is first formed into a side seam blank by rotating the body panel 24 and the side seam flap 26 as a unit about the vertical score line 36, and having the inside surfaces of the body panel 24 come into contact with the inside surface of the body panel 22, with the vertical score line 38 positioned next to the vertical score line 34, and with the inside surface of the side seam flap 26 contacting the inside surface of the body panel 20 adjacent the vertical score line 34. The body panel 18 is then rotated about the vertical score line 32 to bring its inside surface into contact with the inside surface of the body panel 20. The inside surface of the body panel 18 along the edge 28 comes into contact with the outside surface of the side seam flap 26, and the edge 28 is positioned parallel and aligned with the vertical score line 38. The various members of the top end closure 12 and the bottom end closure will make similar movements. The container blank 10 is then sealed where the inside area of the body panel 18 comes into contact with the outside surface of the side seam flap 26. The sealing is accomplished by applying the food grade adhesive to one or both the outside surface of the side seam flap 26 (FIG. 2) and the adjacent mating surface, represented at 111 (FIG. 1), of the body panel 18.

Figure 5:
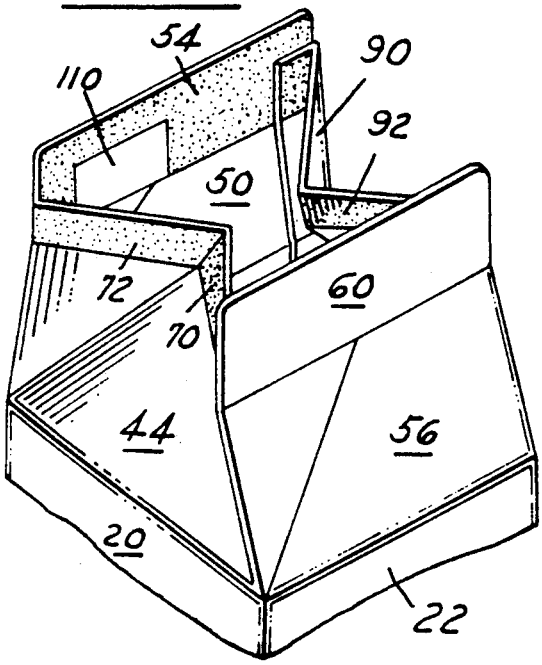
FIG. 5 is an enlarged fragmentary perspective view showing the container evolved from the side seamed blank of FIG. 3 in a partially closed condition.

After the side seam blank is opened up into a squared condition, the bottom end closure is formed and a product, such as milk or juice, is inserted in the container. Thereafter, the various parts of the top end closure 12 are folded about the various score lines in the following manner so as to form the top end structure. The triangular spout panel 44 is moved around the horizontal score line 16 over the end of the filled container and towards its center, as shown in FIG. 5. At the same time, the triangular closure panel 46 is moved toward the middle of the filled container around the horizontal score line 16. The spout panels 70 and 72, and the closure panels 90 and 92 will have their outside surfaces rotated towards each other around the vertical score lines 74 and 94, respectively. The respective surfaces of the lip 72 and the lip 90 contact the sealing panel 54, while the respective surfaces of the lip 70 and the lip 92 contact the closure panel 60, as may be noted from FIGS. 5 and 6.

The sealing of the last mentioned elements of the top closure 12 is accomplished by applying a predetermined minimum pressure to the exterior surfaces of the upper closure panels 54 and 60, thereby causing all adjacent surfaces carrying the food grade adhesive to become sealed together, without requiring the application of heat.

Figure 6:
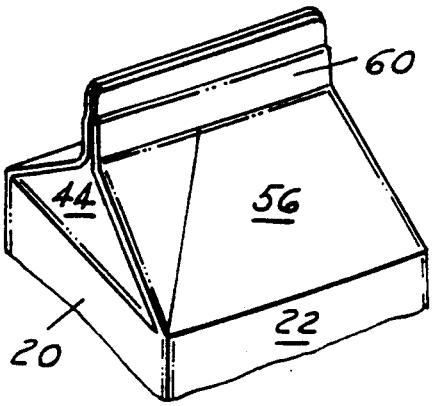
FIG. 6 is a fragmentary perspective view showing the FIG. 5 container in a completely closed condition.

FIG. 6 illustrates the positions of the various elements of the top end closure 12 once the sealing thereof has been effected, i.e., with the sealing panels 54 and 60 being disposed in a position perpendicular to a plane perpendicular to the side panels 18, 20, 22 and 24 to form a top seal.

Figure 8:
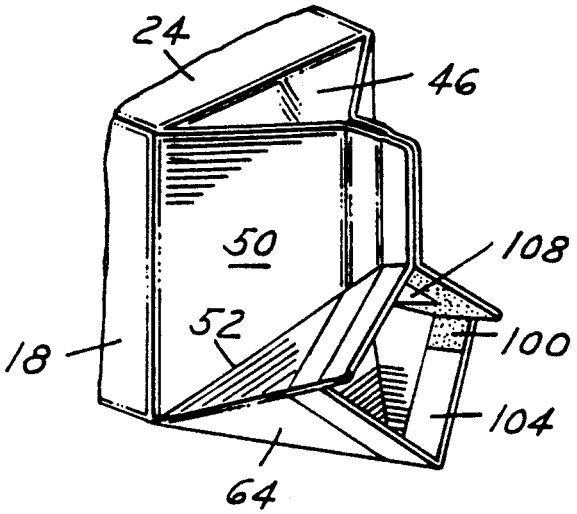
FIG. 8 is a fragmentary perspective view showing the container of FIG. 7 after the pouring spout has been fully opened.
Figure 7:
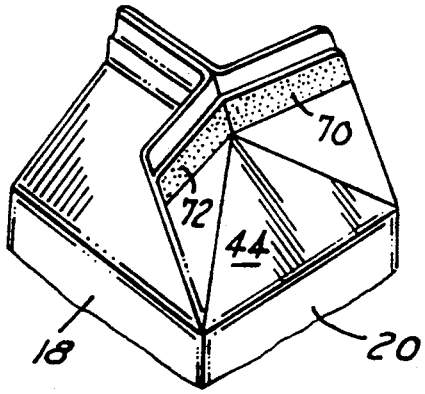
FIG. 7 is a fragmentary perspective view showing the container after the seal of FIGS. 5 and 6 is broken, and with the pouring spout in an intermediate step of the opening process.

Depending upon the type of pressure sensitive food grade (FDA approved) adhesive used, the upper closure panels 54 and 60, which are secured to each other as shown in FIG. 6 by the above mentioned application of pressure, may be prevented from forming a difficult-to-open seal with the inner seal lip associated with the front triangular gable panel by applying an adhesive material in the well known manner to portions of the infold lips 70 and 72, as well as to portions of the laterally adjacent upper closure panels 54 and 60 and as shown by the clear areas 104, 106, 108 and 110. If used, this adhesive coating may be made of any suitable material, such as a silicone based material, that prevents a difficult-to-open sealing between different portions of the container and permits the sealed top end closure to be more easily opened from its closed condition of FIG. 6 through the step shown in FIG. 7 to its open condition of FIG. 8 where the pouring spout is provided.

With respect to the sealing of the bottom end closure 15 (FIGS. 1 and 2) and the well-known panel configuration thereof, in accordance with the principles of the present invention a food grade adhesive would preferably be applied to at least one of each pair of adjacent panel portions adapted to overlap one another, including the following:

FIG. 1 interior: panel portions represented as an extension 112 extending beyond the adjacent edge 113, except for a triangular central portion 115 thereof, triangular portions 114, 116, 118 and 120, an extension 122 beyond the adjacent edge 113, triangular portions 124, 126, 128 and 130, and side seam flap end segment 131, except for a triangular inner edge portion 132, with diagonal score lines 117, 119, 127 and 129 defining the triangular portions 118, 120, 128 and 130, respectively.

FIG. 2 exterior: panel portions represented as an extension 133 extending beyond the adjacent edge 113, and triangular portions 134, 136, 138, 140, 142 and 144, with the score lines 117, 119, 127 and 129 separating the triangular portions 144/142, 140/142, 138/136 and 134/136, respectively.

The respective overlapping or abutting panel portions would then be pressed together on the forming, filling and sealing machine at a predetermined minimum pressure, to complete the sealing therebetween without any possible contamination of the enclosed product.

Figure 9:
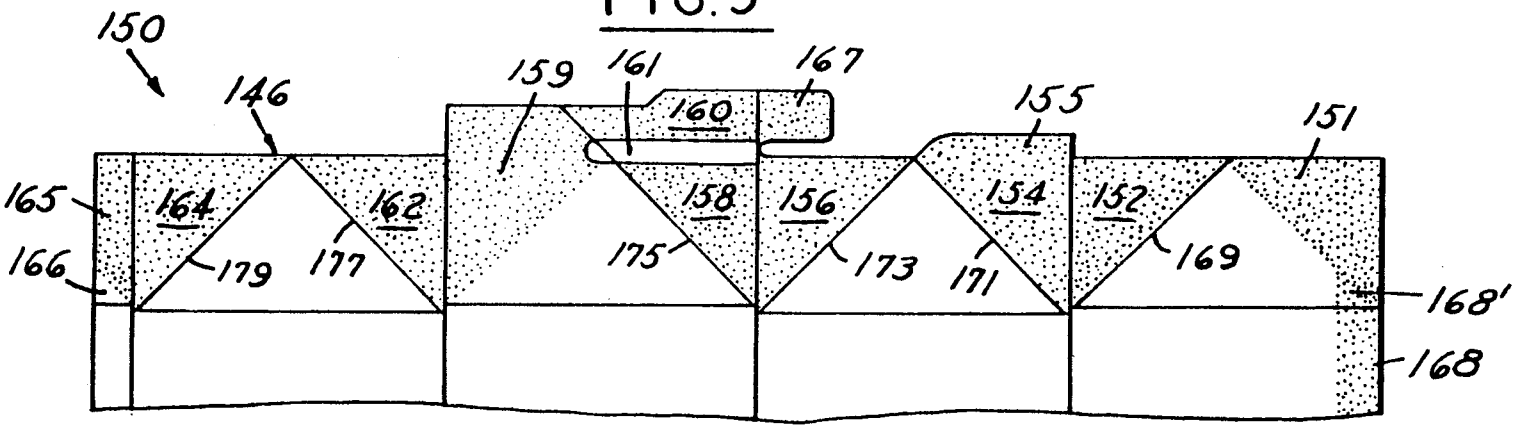
FIGS. 9 and 10 are fragmentary layout views of the inside and outside surfaces of an alternate top end closure adaptable to being sealed in accordance with the present invention.
Figure 10:
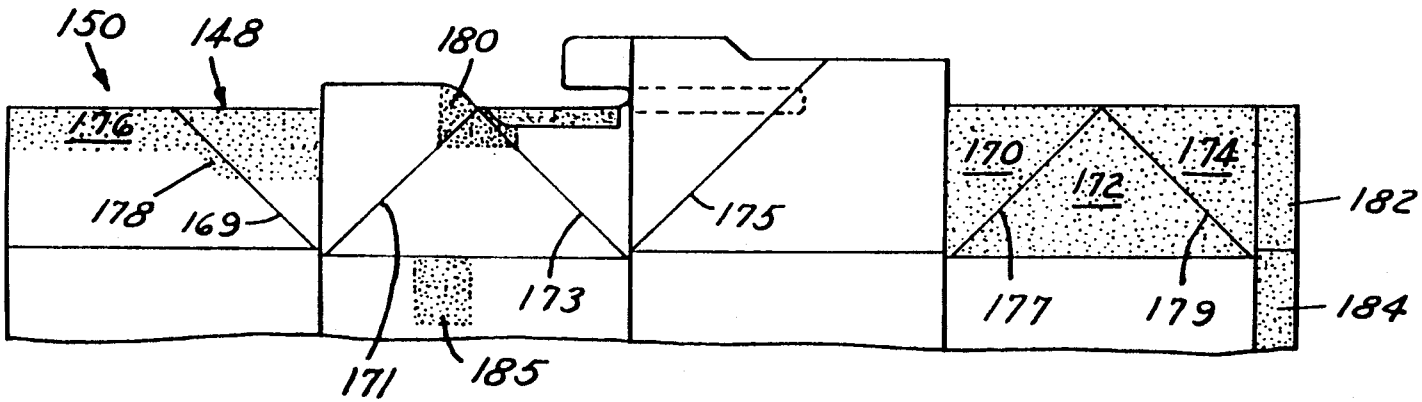

Referring now to FIGS. 9 and 10, there are shown, respectively, the outside 146 and inside 148 surfaces of flat top closure blank 150 disclosed in U.S Pat. No. 4,582,246, incorporated herein by reference; and the surface portions thereof to which the food grade adhesive is applied, and which will be sealed by pressure in forming the closed container (not shown) therefrom. These surface portions are identified by stippling.

The surface portions of the inside top closure surfaces 146 (FIG. 9) to which the adhesive is applied are represented as triangular panels 151, 152, 154, 156, 158, 159, 162 and 164, a lift tab type extension 155 formed at the outer edge of the panel 154, an extension 160 extending beyond the triangular panels 158 and 159, but separated from the panel 158 by a strip 161, a side seam flap end segment 165, except for a triangular inner edge portion 166, a lift tab 167, and a body side panel edge portion. The surface portions of the outside top closure surfaces 148 (FIG. 10) to which the adhesive is applied are represented as triangular closure panels 170, 172 and 174 with score lines 177 and 179 separating the triangular portions 170/172 and 174/172, respectively; a panel edge portion 176 extending across the score line 169, a section 178 adjacent the edge portion 176 coinciding with the contoured portion of the extension 160 (FIG. (), a central portion 180 spanning between the score lines 171 and 173 and outwardly therefrom, the side seam flap end segment 182, the full length side seam flap 184, and an off-center rectangular segment 185 at the upper end of a side panel coinciding with the shape of the lift tab 167 (FIG. 9).

Figure 12:
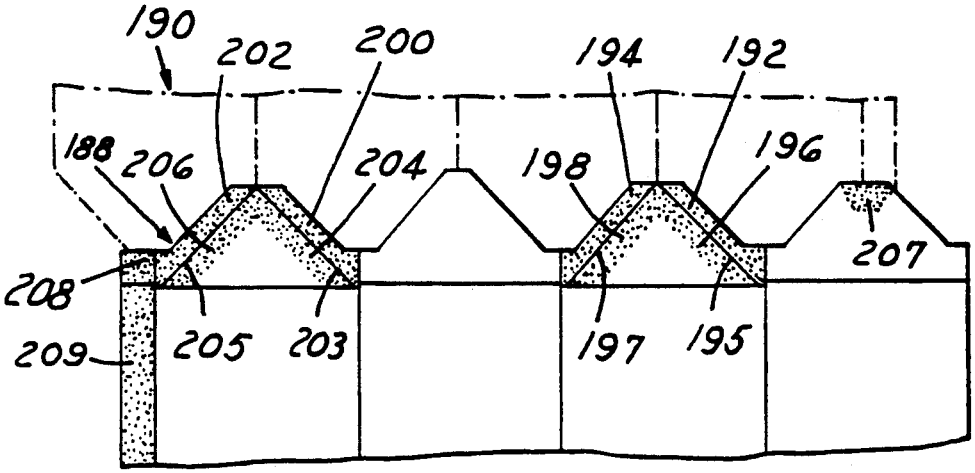
FIGS. 11 and 12 are fragmentary layout views of the inside and outside surfaces of an alternate bottom end closure adaptable to being sealed in accordance with the present invention.
Figure 11:
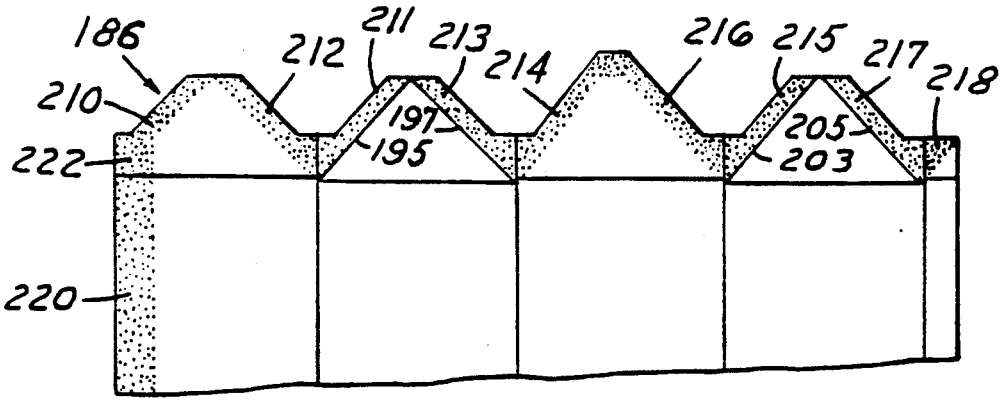

Referring now to FIGS. 11 and 12, there are illustrated, respectively, the inside 186 and outside 188 surfaces of the modified bottom end closure blank 190 disclosed in U.S. Pat. No. 4,341,340, incorporated herein by reference, which may be used in lieu of the bottom end closure 15 shown in FIGS. 1 and 2. In this bottom end closure arrangement, there results a substantial savings in the amount of thermoplastic coated paperboard required, in that the free cut edges of the four closure panels are shaped to include 45° angled edges, rather than the horizontally oriented edges shown in FIGS. 1 and 2. As indicated by phantom lines in FIG. 12, the savings results from the adjacent interdigitated panels of a web or sheet from which the blanks are cut.

The surface portions of the outside surfaces 188 (FIG. 12) of the blank 190 to which the food grade adhesive is applied, and which will be sealed to an adjacent similarly shaped surface by pressure in forming the closed container (not shown) therefrom are identified by stippling as edge portions 192, 194, 200 and 202, adjacent strips 196, 198, 204 and 206 separated, respectively, from the portions 192, 194, 200 and 202 by score lines 195, 197, 203 and 205; a frusto-conical end portion 207 corresponding to a shape to be described, a substantially square side seam extension 208, and the full length of the side seam flap 209.

The surface portions of the inside surfaces 186 (FIG. 11) to which the food grade adhesive is applied, and which will be sealed by pressure in forming the closed container (not shown) therefrom, are identified from left to right in FIG. 11 as pairs of edge portions 210/212, 214/216, and 215/217, a side seam extension portion 218 adjacent the edge portion 217, an edge portion 220 of the side wall to which the side seam flap is adapted to abut against, and the extension 222 thereof which extends to the edge portion 210. The edge portions 211, 213, 215 and 217 are defined by the score lines 195, 197, 203 and 205, respectively. The respective widths of the edge portions 196, 198, 204, 206, 210, 212, 214 and 216 are the same as the width of any of the like edge portions 192, 194, 200, 202, 211, 213, 215 and 217.

As indicated above for the FIGS. 1 and 2 embodiment, the respective overlapping or abutting panel portions of the FIGS. 9 and 10 and FIGS. 11 and 12 arrangements, to which the food grade adhesive have been applied, would require being pressed together while being processed on the forming, filling and sealing machine to complete the sealing therebetween.

INDUSTRIAL APPLICABILITY

It should be apparent that the invention provides novel means of sealing a liquid carrying container without requiring a thermoplastic hot melt, and without requiring the application of heat or high frequency vibration to the usual polyethylene coated outer and inner surfaces.

It should also be apparent that the food grade adhesive could be applied to either or both the abutting surfaces of any top and/or bottom end closure configuration, as well as to the usual side seam flap and the abutting side wall edge portion to effectuate the sealing thereof.

It should be further apparent that the food grade adhesive is applicable to either gable or flat top end closures, as well as to the flat bottom end closure.

It should also be apparent that, by utilizing different types of pressure sensitive food grade (FDA approved) adhesive, a bottom end closure may be sealed so completely that it cannot be opened without causing paper tear, whereas a top end closure may be sealed without substantial paper tear and without the need for an adhesive material to facilitate the easy opening thereof, particularly since the thermoplastic surfaces adjacent thereto do not require being heated and sealed.

While but one embodiment of the invention has been shown and described, other modifications thereof are possible within the scope of the following claims.

The embodiments of the invention in which an exclusive property or privilege is claimed are defined as follows:

1. A container including four interconnected body panels and a bottom closure therefor, a triangular fold-in spout panel formed on the upper end of one of said body panels, a triangular fold-in closure panel formed on one end of a second of said body panels, first and second oppositely disposed lower closure panels, first and second sets of triangular fold-back panels interconnecting said spout panel and said closure panel, respectively, with said respective lower closure panels, and being folded against the latter, first and second upper closure panels extending vertically from said respective first and second lower closure panels, and first and second infold lips extending vertically from each of said respective first and second sets of fold-back panels and being folded toward one another and sealed between said first and second upper closure panels, characterized by a food grade adhesive applied to the exterior surfaces of at least one infold lip of each of said first and second sets of infold lips, to the interior surfaces of at least one of said second set of infold lips, to at least one of the extreme left and right edge portions of the interior surfaces of said first set of infold lips, and to the interior surfaces of one of said first and second upper closure panels except for portions thereof directly opposite the portions of said first set of infold lips not covered with adhesive.

2. A blank for constructing a container, the blank including:

(a) body panels including front and back panels and a pair of side panels, (b) first and second oppositely disposed triangular gable panels connected to the top ends of said front and back panels, (c) first and second oppositely disposed lower closure panels connected to the top ends of said side panels, (d) first and second sets of fold-back panels interconnecting said respective first and second triangular gable panels and lower closure panels, and being folded against the latter, (e) first and second upper closure panels connected to said respective first and second lower closure panels, and having a first abhesive pattern selectively formed on each inner surface thereof, and (f) first and second infold lips connected to each of said respective first and second sets of foldback panels and adapted to being folded toward one another between said first and second upper closure panels, and having a second abhesive pattern formed on the inside surfaces of one set of said first and second infold lips so as to be directly opposite said first abhesive patterns once the blank is folded, characterized by a food grade adhesive applied to the exterior surfaces of each of said first and second sets of infold lips, to the interior surfaces of said second set of infold lips, to the extreme left and right edge portions of the interior surfaces of said first set of infold lips, and to the interior surfaces of said first and second upper closure panels except for portions thereof adapted to be opposite the portions of said first set of infold lips not covered with adhesive once the blank is folded.

3. A blank for constructing a container including four interconnected body panels, a side seam flap, and a top closure therefor, a side seam flap extension, and four foldable rectangular bottom closure panels, two of which are each divided by diagonal score lines into a central and two adjacent side triangular portions, and the other two of which each have a contoured extension formed thereon, characterized by a food grade adhesive applied to the interior surfaces of each of said two adjacent side triangular portions of said two panels divided by diagonal score lines, and to similar side triangular areas of each of the other two rectangular bottom closure panels, to the full exterior surface of each of said central and two adjacent side triangular portions of each of said two panels which are divided by said diagonal score lines, to the interior surfaces of each of said contoured extensions, except for a central triangular portion of one of them, to the exterior surface of the latter contoured extension, and to both the interior and exterior surfaces of the side seam flap extension except for an inner triangular portion of the interior surface of the side seam flap extension.

4. The blank described in claim 3, characterized by a food grade adhesive applied to at least one of the exterior surfaces of said side seam flap, or to the interior surface of the edge portion of the body panel farthest away from the side seam flap and of a width equal to the width of the side seam flap.

5. A blank for constructing a container including four interconnected body panels, a side seam flap, and a top closure therefor, a side seam flap extension, and four foldable rectangular bottom closure panels, two of which are each divided by diagonal score lines into a central and two adjacent side triangular portions, and the other two of which each have a contoured extension formed thereon, characterized by a food grade adhesive applied to the interior surfaces of at least one of either of said two adjacent side triangular portions of said two panels divided by diagonal score lines, or to each of similar side triangular areas of each of the other two rectangular bottom closure panels; and to the exterior surfaces of at least one of each of said two adjacent side triangular portions of said two panels divided by diagonal score lines, or to each of said central triangular portions.

* * * * *